US006412736B1

(12) United States Patent
Zaragoza

(10) Patent No.: US 6,412,736 B1
(45) Date of Patent: Jul. 2, 2002

(54) COLLAPSIBLE PINATA HOIST

(76) Inventor: Marie Zaragoza, 1332 S. 4th Ave., Yuma, AZ (US) 85364

( * ) Notice: Subject to any disclaimer, the term of this patent is extended or adjusted under 35 U.S.C. 154(b) by 14 days.

(21) Appl. No.: 09/710,639

(22) Filed: Nov. 8, 2000

(51) Int. Cl.[7] ..... A47F 5/00

(52) U.S. Cl. ..... 248/125.8; 212/179; 248/332; 473/418; 473/429

(58) Field of Search ..... 248/125.2, 903, 248/910, 317, 320, 329, 332; 212/179, 224; 473/428, 575, 418, 429; 182/36, 37

(56) References Cited

U.S. PATENT DOCUMENTS

| | | | | | |
|---|---|---|---|---|---|
| 611,263 | A | * | 9/1898 | Louis | 212/179 |
| 873,374 | A | * | 12/1907 | Jenkins | 212/179 |
| 1,319,964 | A | * | 10/1919 | Morgan | 212/179 |
| 2,338,317 | A | * | 1/1944 | Coates | 212/179 |
| 2,513,403 | A | * | 7/1950 | Dakin | 212/179 |
| 3,893,669 | A | * | 7/1975 | Myers | 473/418 |
| 3,953,028 | A | | 4/1976 | Gowins | 273/26 |
| 4,158,458 | A | | 6/1979 | Gomez | 273/95 |
| 4,269,410 | A | | 5/1981 | Martin | 273/29 |
| 5,060,946 | A | | 10/1991 | Taylor | 273/411 |
| 5,622,237 | A | | 4/1997 | Moldow | 182/87 |

* cited by examiner

*Primary Examiner*—Leslie A. Braun
*Assistant Examiner*—Tan Le
(74) *Attorney, Agent, or Firm*—Joseph N. Breaux

(57) ABSTRACT

A collapsible pinata hoist to eliminate the need for finding a large tree or other pinata rope support structure when it is desired to have a pinata at a gathering such as a birthday party or other celebration. The collapsible pinata hoist includes a V-shaped base assembly, a vertical support pole assembly, a horizontal support pole and pulley assembly, two brace members each having an element locking pin receiving aperture at both ends thereof, a number of element locking pins and a flexible pinata pulling tether member. The flexible pinata tether member is threaded through pulley assemblies provided at each end of the horizontal support pole and has one end attached to a pinata and the other end free to be pulled on by a pinata handler to allow for lifting and lowering of the pinata while a person is trying to break the pinata open with a stick.

1 Claim, 3 Drawing Sheets

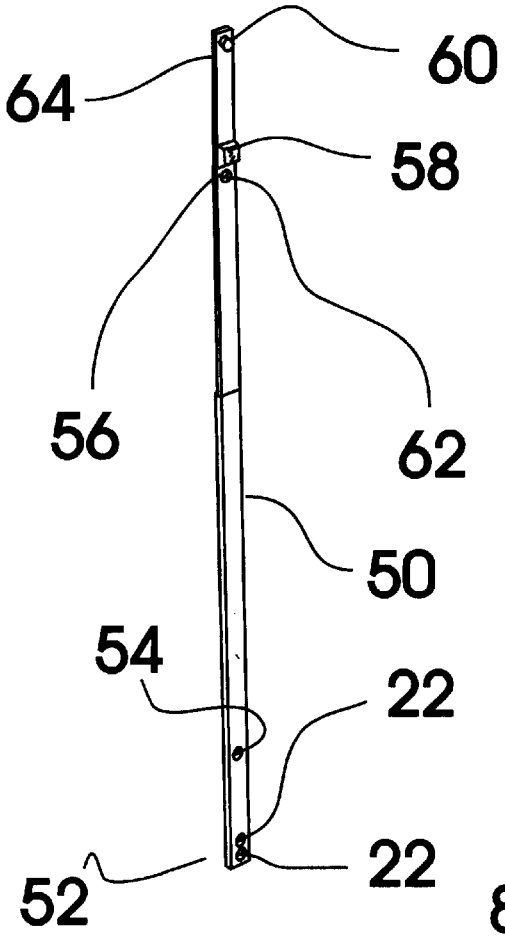
FIG.2
FIG.3
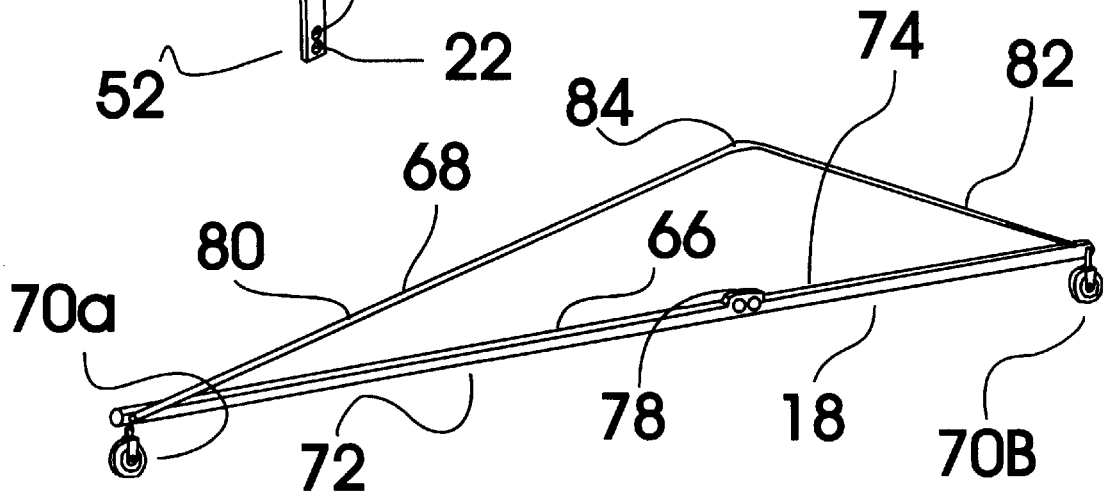

COLLAPSIBLE PINATA HOIST

TECHNICAL FIELD

The present invention relates to collapsible support structures and more particularly to a collapsible pinata hoist to eliminate the need for finding a large tree or other pinata rope support structure when it is desired to have a pinata at a gathering such as a birthday party or other celebration; the collapsible pinata hoist including a V-shaped base assembly, a vertical support pole assembly, a horizontal support pole and pulley assembly, two brace members each having an element locking pin receiving aperture at both ends thereof, a number of element locking pins and a flexible pinata pulling tether member that is threaded through the pulley assemblies and one end attached to a pinata and the other end pulled on by the person lifting and lowering the pinata while a person is trying to break the pinata open with a stick.

BACKGROUND ART

Many individuals enjoy having a pinata at celebrations such as birthday parties. The pinata is traditionally supported by a rope or the like which is slung over a tree limb or some other high support structure and then manipulated by a handler who pulls on the free end of the rope to make hitting the pinata harder. Although in many areas it is easy to find an elevated support for the pinata rope, many new subdivisions and the like have few if any trees large enough to perform this function. It would be desirable, therefore, to have a collapsible pinata hoist that could be disassembled for transport and storage and which could be rapidly put together to provide a support for the pinata rope.

GENERAL SUMMARY DISCUSSION OF INVENTION

It is thus an object of the invention to provide a collapsible pinata hoist that includes a V-shaped base assembly, a vertical support pole assembly, a horizontal support pole and pulley assembly, two brace members each having an element locking pin receiving aperture at both ends thereof, a number of element locking pins and a flexible pinata pulling tether member; the V-shaped base assembly including two rigid base bracket bars and a rigid vertical support pole connecting plate having a pair of spaced element locking pin receiving apertures provided therethrough; each of the two rigid base bracket bars having a bracket connecting end in rigid connection with the bracket connecting end of the other rigid base bracket bar to form a juncture portion to which the rigid vertical support pole connecting plate is rigidly attached such that the rigid vertical support pole connecting plate extends upward perpendicularly from a geometric plane defined by the two rigid bracket bars, a weight container attachment end to which a container member having a user fillable weight material receiving cavity is attached, and a brace member attachment tab extending upward from a middle portion thereof and through which an element locking pin receiving aperture is provided; the two rigid base bracket bars being oriented with respect to each other at an angle of between 120 and 60 degrees; the vertical support pole assembly including an elongated, flat, rigid vertical support bar having a bottom connecting plate portion, a brace member connecting element locking pin receiving aperture, a horizontal support pole and pulley assembly element locking pin receiving aperture, a rigid stabilizer block, and a cable support bolt; the bottom connecting plate portion being provided with two spaced element locking pin receiving apertures provided therethrough that are spaced to companionately align with the pair of spaced element locking pin receiving apertures of the rigid vertical support pole connecting plate such that the bottom connecting plate portion of the elongated, flat, rigid vertical support bar is rigidly securable to the rigid vertical support pole connecting plate of the V-shaped base assembly by inserting two element locking pins through the aligned element locking pin receiving apertures of the bottom connecting plate portion and the rigid vertical support pole connecting plate; the brace member element locking pin aperture being provided through a bottom-third portion of the elongated, flat, rigid vertical support bar at a location such that each of the two brace members is attachable between the elongated, flat, rigid vertical support bar and a respective one of the brace member attachment tabs by positioning and aligning the respective element locking pin receiving apertures it and inserting therethrough an element locking pin; the horizontal support pole and pulley assembly element locking pin receiving aperture being provided through an upper-third portion of the elongated, flat, rigid vertical support bar; the rigid stabilizer block being rigidly attached to the elongated, flat, rigid vertical support bar a fixed distance from an opening of the horizontal support pole and pulley assembly element locking pin receiving aperture; the cable support bolt extending outwardly from a top end of the elongated, flat, rigid vertical support bar; the horizontal support pole and pulley assembly including a horizontal support pole member, a support pole member tension support element, and two pulley assemblies; the horizontal support pole member having a pinata support end with a pulley assembly connected thereto, a pinata puller end with a pulley assembly connected thereto, and a flat vertical support bar connecting portion positioned between the pinata support end and the pinata puller end; the flat vertical support bar connecting portion being provided with an element locking pin receiving aperture therethrough and sized such that, when the horizontal support pole and pulley assembly element locking pin receiving aperture is aligned with the element locking pin receiving aperture of the flat vertical support bar connecting portion and an element locking pin inserted therethrough, the rigid stabilizer block prevents rotation of the horizontal support pole it member with respect to the elongated, flat, rigid vertical support bar; the support pole tension support element having a first end connected to the pinata support end of the horizontal support pole member and a second end connected to the pinata puller end of the horizontal support pole member; the length of the support pole member tension support element being selected such that a portion of the support pole member tension support element is supported on the cable support bolt extending outwardly from the top end of the elongated, flat, rigid vertical support bar such that the support pole member tension support element provides tensional support to the pinata support end of the horizontal support pole member and the pinata puller end of the horizontal support pole member when the horizontal support pole and pulley assembly element locking pin receiving aperture is aligned with the element locking pin receiving aperture of the flat vertical support bar connecting portion and an element locking pin inserted therethrough; the pinata pulling tether member being threaded through the two pulley assemblies.

Accordingly, a collapsible pinata hoist is provided. The collapsible pinata hoist includes a V-shaped base assembly, a vertical support pole assembly, a horizontal support pole and pulley assembly, two brace members each having an element locking pin receiving aperture at both ends thereof, a number of element locking pins and a flexible pinata pulling tether member; the V-shaped base assembly including two rigid base bracket bars and a rigid vertical support pole connecting plate having a pair of spaced element locking pin receiving apertures provided therethrough; each of the two rigid base bracket bars having a bracket connecting end in rigid connection with the bracket connecting end of the other rigid base bracket bar to form a juncture portion to which the rigid vertical support pole connecting plate is rigidly attached such that the rigid vertical support pole connecting plate extends upward perpendicularly from a geometric plane defined by the two rigid bracket bars, a weight container attachment end to which a container member having a user fillable weight material receiving cavity is attached, and a brace member attachment tab extending upward from a middle portion thereof and through which an element locking pin receiving aperture is provided; the two rigid base bracket bars being oriented with respect to each other at an angle of between 120 and 60 degrees; the vertical support pole assembly including an elongated, flat, rigid vertical support bar having a bottom connecting plate portion, a brace member connecting element locking pin receiving aperture, a horizontal support pole and pulley assembly element a locking pin receiving aperture, a rigid stabilizer block, and a cable support bolt; the bottom connecting plate portion being provided with two spaced element locking pin receiving apertures provided therethrough that are spaced to companionately align with the pair of spaced element locking pin receiving apertures of the rigid vertical support pole connecting plate such that the bottom connecting plate portion of the elongated, flat, rigid vertical support bar is rigidly securable to the rigid vertical support pole connecting plate of the V-shaped base assembly by inserting two element locking pins through the aligned element locking pin receiving apertures of the bottom connecting plate portion and the rigid vertical support pole connecting plate; the brace member element locking pin aperture being provided through a bottom-third portion of the elongated, flat, rigid vertical support bar at a location such that each of the two brace members is attachable between the elongated, flat, rigid vertical support bar and a respective one of the brace member attachment tabs by positioning and aligning the respective element locking pin receiving apertures and inserting therethrough an element locking pin; the horizontal support pole and pulley assembly element locking pin receiving aperture being provided through an upper-third portion of the elongated, flat, rigid vertical support bar; the rigid stabilizer block being rigidly attached to the elongated, flat, rigid vertical support bar a fixed distance from an opening of the horizontal support pole and pulley assembly element locking pin receiving aperture; the cable support bolt extending outwardly from a top end of the elongated, flat, rigid vertical support bar; the horizontal support pole and pulley assembly including a horizontal support pole member, a support pole member tension support element, and two pulley assemblies; the horizontal support pole member having a pinata support end with a pulley assembly connected thereto, a pinata puller end with a pulley assembly connected thereto, and a flat vertical support bar connecting portion positioned between the pinata support end and the pinata puller end; the flat vertical support bar connecting portion being provided with an element locking pin receiving aperture therethrough and sized such that, when the horizontal support pole and pulley assembly element locking pin receiving aperture is aligned with the element locking pin receiving aperture of the flat vertical support bar connecting portion and an element locking pin inserted therethrough, the rigid stabilizer block prevents rotation of the horizontal support pole member with respect to the elongated, flat, rigid vertical support bar; the support pole tension support element having a first end connected to the pinata support end of the horizontal support pole member and a second end connected to the pinata puller end of the horizontal support pole member; the length of the support pole member tension support element being selected such that a portion of the support pole member tension support element is supported on the cable support bolt extending outwardly from the top end of the elongated, flat, rigid vertical support bar such that the support pole member tension support element provides tensional support to the pinata support end of the horizontal support pole member and the pinata puller end of the horizontal support pole member when the horizontal support pole and pulley assembly element locking pin receiving aperture is aligned with the element locking pin receiving aperture of the flat vertical support bar connecting portion and an element locking pin inserted therethrough; the pinata pulling tether member being threaded through the two pulley assemblies.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein:

FIG. 2 is a perspective view of the vertical support pole assembly in isolation.

FIG. 3 is a perspective view of the horizontal support pole and pulley assembly in isolation.

EXEMPLARY MODE FOR CARRYING OUT THE INVENTION

Figure 1:
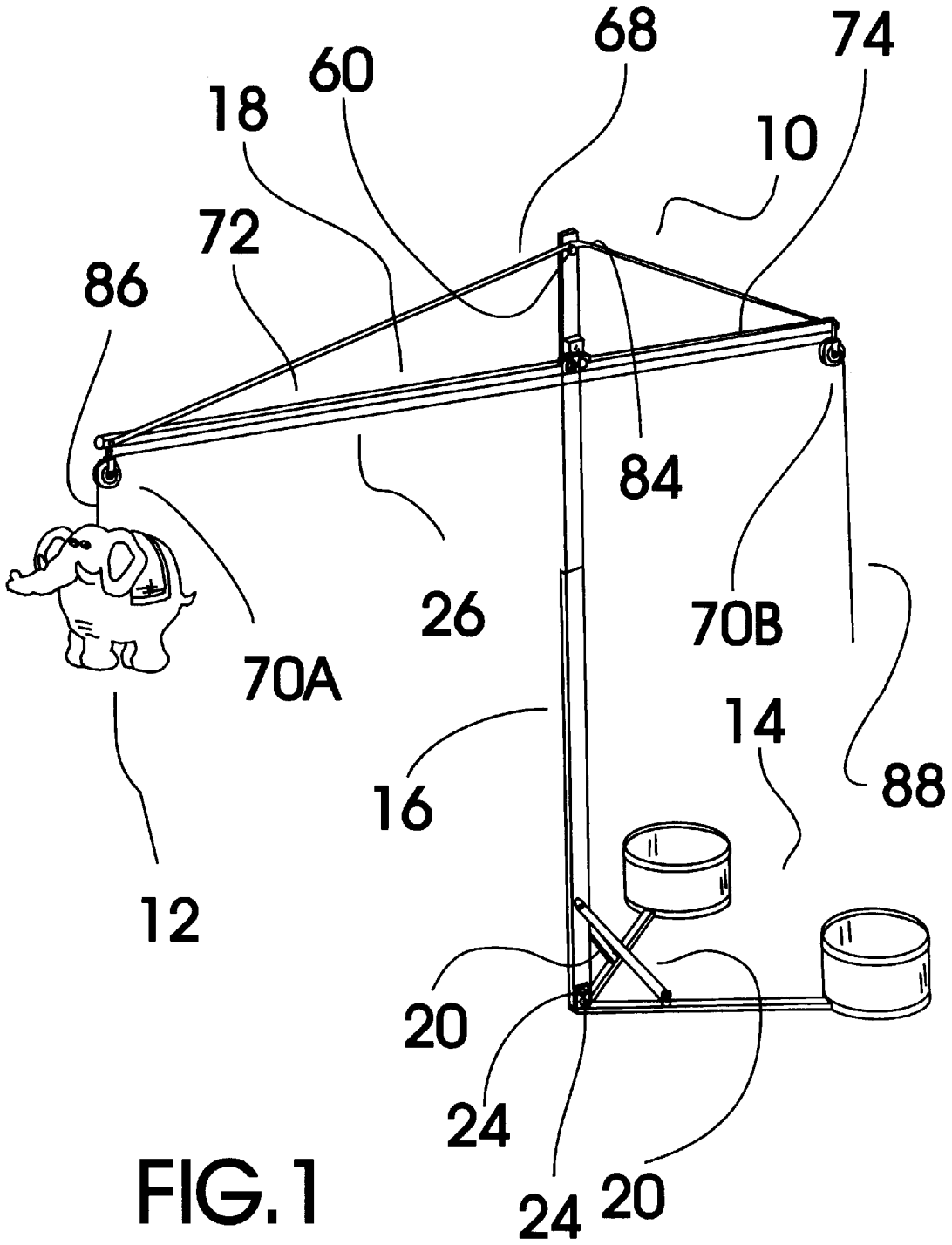
FIG. 1 is a perspective view of an exemplary embodiment of the collapsible pinata hoist of the present invention showing the V-shaped base assembly, the vertical support pole assembly, the horizontal support pole and pulley assembly, the two brace members each having an element locking pin receiving aperture at both ends thereof, the number of element locking pins and the flexible pinata pulling tether member.
Figure 5:
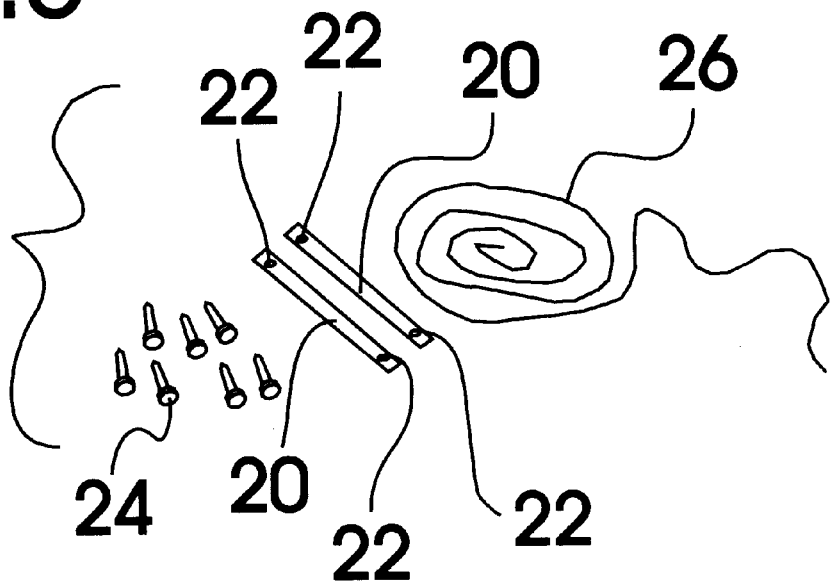
FIG. 5 is a perspective view showing the two brace members, the number of element locking pins and the flexible pinata pulling tether member.
Figure 4:
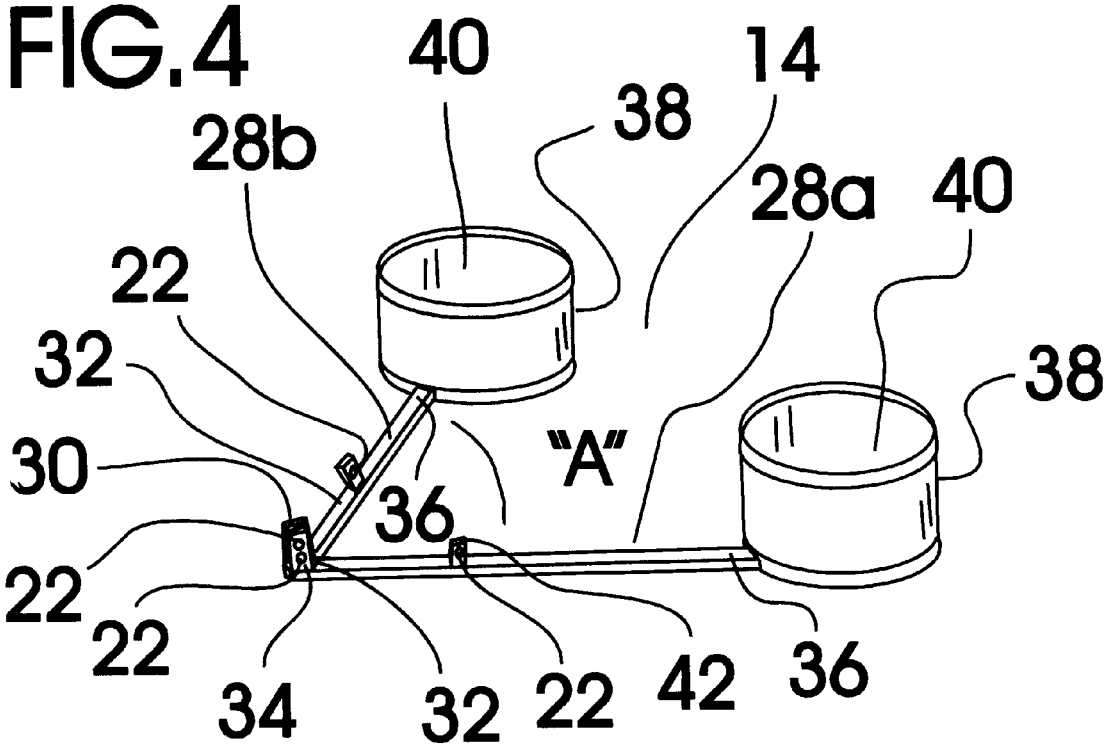
FIG. 4 is a perspective view of the V-shaped base assembly in isolation.

FIGS. 1–5 show various aspects of an exemplary embodiment of the collapsible pinata hoist of the present invention generally designated 10. Collapsible pinata hoist 10 is adapted for use with a pinata, generally designated 12, and includes a V-shaped base assembly, generally designated 14; a vertical support pole assembly, generally designated 16; a horizontal support pole and pulley assembly, generally designated 18; two brace members, generally designated 20, each having an element locking pin receiving aperture 22 at both ends thereof; a number of element locking pins 24; and a flexible pinata pulling tether member, generally designated 26.

V-shaped base assembly 14 including two rigid base bracket bars, generally designated 28*a*,28*b*, and a rigid vertical support pole connecting plate, generally designated 30, having a pair of spaced element locking pin receiving apertures 22 provided therethrough. Each of the two rigid base bracket bars 28*a*,28*b* has a bracket connecting end 30 in rigid connection with the bracket connecting end 32 of the other rigid base bracket bar 28*a*,28*b* to form a juncture portion 34 to which rigid vertical support pole connecting plate 30 is rigidly attached. Rigid vertical support pole connecting plate 30 extends upward perpendicularly from a geometric plane defined by the two rigid bracket bars 28*a*,28*b*. Each of the two rigid base bracket bars 28*a*,28*b* also has a weight container attachment end 36 to which a container member, generally designated 38, having a user fillable weight material receiving cavity 40 is rigidly attached. A brace member attachment tab, generally designated 42 extends upward from a middle portion of each rigid bracket bar 28*a*,28*b*. An element locking pin receiving aperture 22 is provided through each of the brace member attachment tabs 42. In this embodiment, rigid base bracket bars 28*a*,28*b* are oriented with respect to each other at an angle "A" of ninety degrees.

Vertical support pole assembly 16 includes an elongated, flat, rigid vertical support bar, generally designated 50 having a bottom connecting plate portion, generally designated 52; a brace member connecting element locking pin receiving aperture 54; a horizontal support pole and pulley assembly element locking pin receiving aperture 56; a rigid stabilizer block 58; and a cable support bolt 60. Bottom connecting plate portion 52 is provided with two spaced element locking pin receiving apertures 22 provided therethrough that are spaced to companionately align with the pair of spaced element locking pin receiving apertures 22 of the rigid vertical support pole connecting plate 30 such that the bottom connecting plate portion 52 is rigidly securable to rigid vertical support pole connecting plate 30 by inserting two element locking pins 24 through the aligned element locking pin receiving apertures 22 of the bottom connecting plate portion 52 and the rigid vertical support pole connecting plate 30. Brace member element locking pin aperture 54 is provided through a bottom-third portion of the elongated, flat, rigid vertical support bar 50 at a location selected such that each of the two brace members 20 is attachable between the elongated, flat, rigid vertical support bar 50 and a respective one of the brace member attachment tabs 42 by positioning and aligning the respective element locking pin receiving apertures 22,54 and inserting therethrough an element locking pin 24. Horizontal support pole and pulley assembly element locking pin receiving aperture 56 is provided through an upper-third portion of elongated, flat, rigid vertical support bar 50. Rigid stabilizer block 58 is rigidly attached to elongated, flat, rigid vertical support bar 50 a fixed distance from a pin insertion opening 62 of horizontal support pole and pulley assembly element locking pin receiving aperture 56. Cable support bolt 60 extends outwardly from a top end 64 of elongated, flat, rigid vertical support bar 50.

Horizontal support pole and pulley assembly 18 includes a horizontal support pole member, generally designated 66; a support pole member tension support element, generally designated 68; and two pulley assemblies, generally designated 70*a*,70*b*. Horizontal support pole member 66 has tubular pinata support end, generally designated 72 with a pulley assembly 70*a* connected thereto and a tubular pinata puller end, generally designated 74, with a pulley assembly 70*b* connected thereto and connected to tubular pinata support end 72 by a flat vertical support bar connecting portion, generally designated 78 welded between tubular pinata support end 72 and tubular pinata puller end 74. Flat vertical support bar connecting portion 78 is provided with an element locking pin receiving aperture 22 therethrough and is sized such that, when the horizontal support pole and pulley assembly element locking pin receiving aperture 56 is aligned with element locking pin receiving aperture 22 of flat vertical support bar connecting portion 78 and an element locking pin 24 inserted therethrough, rigid stabilizer block 58 prevents rotation of horizontal support pole member 66 with respect to elongated, flat rigid vertical support bar 50.

Support pole tension support element 68 is constructed of stainless steel cable and has a first end 80 connected to pinata support end 72 of horizontal support pole member 66 and a second end 82 connected to pinata puller end 74 of horizontal support pole member 66. The length of support pole member tension support element 68 is selected such that a portion 84 of support pole member tension support element 68 is supported on cable support bolt 60 such that support pole member tension support element 68 provides tensional support to pinata end 72 and pinata puller end 74 of horizontal support pole member 66 when horizontal support pole and pulley assembly element locking pin receiving aperture 56 is aligned with element locking pin receiving aperture 22 of flat vertical support bar connecting portion 78 and an element locking pin 24 is inserted therethrough.

In this embodiment, pinata pulling tether member 26 is a length of nylon rope and is threaded through pulley assemblies 70*a*,70*b* and one end 86 attached to respective pinata 12 and a free end 88 dangling down from pulley 70*b* to be grasped and pulled on by the pinata handler to lift and lower the pinata 12 while a person attempts to strike the pinata 12 while blindfolded.

It can be seen by the preceding description that a collapsible pinata hoist has been provided.

It is noticed that the embodiment of the collapsible pinata hoist described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood and not in a limiting sense.

What is claimed is:

1. A collapsible pinata hoist comprising:

a V-shaped base assembly;

a vertical support pole assembly;

a horizontal support pole and assembly;

two brace members each having an element locking pin receiving aperture at both ends thereof;

a number of element locking pins; and said V-shaped base assembly including two rigid base bracket bars and a rigid vertical support pole connecting plate having a pair of spaced element locking pin receiving apertures provided therethrough;

each of said two rigid base bracket bars having a bracket connecting end in rigid connection with said bracket connecting end of said other rigid base bracket bar to form a juncture portion to which said rigid vertical support pole connecting plate is rigidly attached such that said rigid vertical support pole connecting plate extends upward perpendicularly from a geometric plane defined by said two rigid bracket bars, a weight container attachment end to which a container member having a user fillable weight material receiving cavity is attached, and a brace member attachment tab extending upward from a middle portion thereof and through which an element locking pin receiving aperture is provided;

said two rigid base bracket bars being oriented with respect to each other at an angle of between 120 and 60 degrees;

said vertical support pole assembly including an elongated, flat, rigid vertical support bar having a bottom connecting plate portion, a brace member connecting element locking pin receiving aperture, a horizontal support pole and pulley assembly element locking pin receiving aperture, a rigid stabilizer block, and a cable support bolt;

said bottom connecting plate being provided with two spaced element locking pins receiving aperture provided therethrough that are spaced to companionately align with said pair of spaced element locking pin receiving apertures of said rigid vertical support pole connecting plate such that said bottom connecting plate portion of said elongated, flat, rigid vertical support bar is rigidly securable to said rigid vertical support pole connecting plate of said V-shaped base assembly by inserting two element locking pins through said aligned element locking pin receiving apertures of said bottom connecting plate portion and said rigid support pole connecting plate;

said brace member element locking pin aperture being provided through a bottom-third portion of said elongated, flat, rigid vertical support bar at a location such that each of said two brace members is attachable between said elongated, flat, rigid vertical support bar and a respective one of said brace member attachment tabs by positioning said aligning said respective element locking pin receiving apertures and inserting therethrough an element locking pin;

said horizontal support pole and pulley assembly element locking pin receiving aperture being provided through an upper-third portion of said elongated, flat, rigid vertical support bar;

said rigid stabilizer block being rigidly attached to said elongated, flat, rigid vertical support bar a fixed distance from an opening of said horizontal support pole and pulley assembly element locking pin receiving aperture;

said cable support bolt extending outwardly from a top end of said elongated, flat, rigid vertical support bar;

said horizontal support pole and pulley assembly including a horizontal support pole member, a support pole member tension support element, and two pulley assemblies;

said horizontal support pole member having a pinata support end with a pulley assembly connected thereto, a pinata puller end with a pulley assembly connected thereto, and flat vertical support bar connecting portion positioned between said pinata support end and said pinata puller end;

said flat vertical support bar connecting portion being provided with an element locking pin receiving aperture therethrough and sized such that, when said horizontal support pole and pulley assembly element locking pin receiving aperture is aligned with said element locking pin receiving aperture of said flat vertical support bar connecting portion and an element locking pin inserted therethrough, said rigid stabilizer block prevents rotation of said horizontal support pole member with respect to said elongated, flat, rigid vertical support bar;

said support pole tension support element having a first end connected to said pinata support end of said horizontal support pole member and a second end connected to said pinata puller end of said horizontal support pole member;

said length of said support pole member tension support element being selected such that a portion of said support pole member tension support element is supported on said cable support bolt extending outwardly from said top end of said elongated, flat, rigid vertical support bar such that said support pole member tension support element provides tensional support to said pinata support end of said horizontal support pole member and said pinata puller end of said horizontal support pole member when said horizontal support pole and pulley assembly element locking pin receiving aperture is aligned with said element locking pin receiving aperture of said flat vertical support bar connecting portion and an element locking pin inserted therethrough;

said pinata pulling tether member being through said two pulley assemblies.

* * * * *